US007419528B2

(12) United States Patent
Shamblen et al.

(10) Patent No.: US 7,419,528 B2
(45) **Date of Patent: *Sep. 2, 2008**

(54) METHOD FOR FABRICATING A SUPERALLOY ARTICLE WITHOUT ANY MELTING

(75) Inventors: Clifford Earl Shamblen, Cincinnati, OH (US); Andrew Philip Woodfield, Cincinnati, OH (US); Eric Allen Ott, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 361 days.

This patent is subject to a terminal disclaimer.

(21) Appl. No.: 10/371,743

(22) Filed: Feb. 19, 2003

(65) Prior Publication Data

US 2004/0159185 A1 Aug. 19, 2004

(51) Int. Cl.
*B22F 3/00* (2006.01)

(52) U.S. Cl. ..... 75/351; 75/368; 75/369; 419/41; 419/49

(58) Field of Classification Search ..... 75/351, 75/368, 369; 419/41, 49
See application file for complete search history.

(56) References Cited

U.S. PATENT DOCUMENTS

| | | | | |
|---|---|---|---|---|
| 2,937,979 | A * | 5/1960 | Wainer | 205/45 |
| 4,383,852 | A * | 5/1983 | Yoshizawa | 75/363 |
| 4,415,528 | A * | 11/1983 | Wiech, Jr. | 419/46 |
| 4,519,839 | A * | 5/1985 | Toyoaki et al. | 75/242 |
| 4,894,086 | A | 1/1990 | Huether et al. | |
| 5,322,666 | A | 6/1994 | Watwe | |
| 5,779,761 | A | 7/1998 | Armstrong et al. | |
| 5,930,580 | A | 7/1999 | Everett | |
| 5,958,106 | A | 9/1999 | Armstrong et al. | |
| 6,926,754 | B2 * | 8/2005 | Shamblen et al. | 75/765 |
| 6,926,755 | B2 * | 8/2005 | Shamblen et al. | 75/765 |
| 6,968,990 | B2 * | 11/2005 | Ott et al. | 228/203 |

FOREIGN PATENT DOCUMENTS

WO WO99/64638 12/1999

OTHER PUBLICATIONS

Doyle, Eoghan T.M. et al. "Carbothermic reduction of nickel-cobalt-chromium oxide mixture for the production of NiCoCr superalloy powder" EPD Congr. 1992, Proc. Symp. TMS Annu. Meet., 745-58. Editor(s): Hager, John P.; Publisher: Miner. Met. Mater. Soc., Warrendale, PA. Coden: 58HHA7, 1992, XP0009029023.

Gerdemann et al., Characterization of a Titanium Powder Produced Through a Novel Continuous Process, U.S. Department of Energy, Albany Research Center, Albany, Oregon, 2000, pp. 12-44 through 12-52, USA.

Moxson et al., Producton, Characterization and Application of Low Cost Titanium Powder Products, the Minerals, Metals & Materials Society, 1998, pp. 127-134, USA.

Baburaj et al., Production of Low Cost Titanium, The Minerals, Metals & Materials, 1998, pp. 89-97, USA.

Gerdemann, Steven J., Titanium Process Technologies, Advanced Materials & Processes, Jul. 2001, pp. 41-43, USA.

* cited by examiner

*Primary Examiner*—Roy King
*Assistant Examiner*—Ngoclan T. Mai
(74) *Attorney, Agent, or Firm*—McNees Wallace & Nurick, LLC

(57) ABSTRACT

A metallic article made of metallic constituent elements is fabricated from a mixture of nonmetallic precursor compounds of the metallic constituent elements. The mixture of nonmetallic precursor compounds contains more of a base-metal element, such as nickel, cobalt, iron, iron-nickel, and iron-nickel-cobalt than any other metallic element. The mixture of nonmetallic precursor compounds is chemically reduced to produce a metallic superalloy material, without melting the metallic superalloy material. The metallic superalloy material is consolidated to produce a consolidated metallic article, without melting the metallic superalloy material and without melting the consolidated metallic article.

39 Claims, 2 Drawing Sheets

FIG. 1
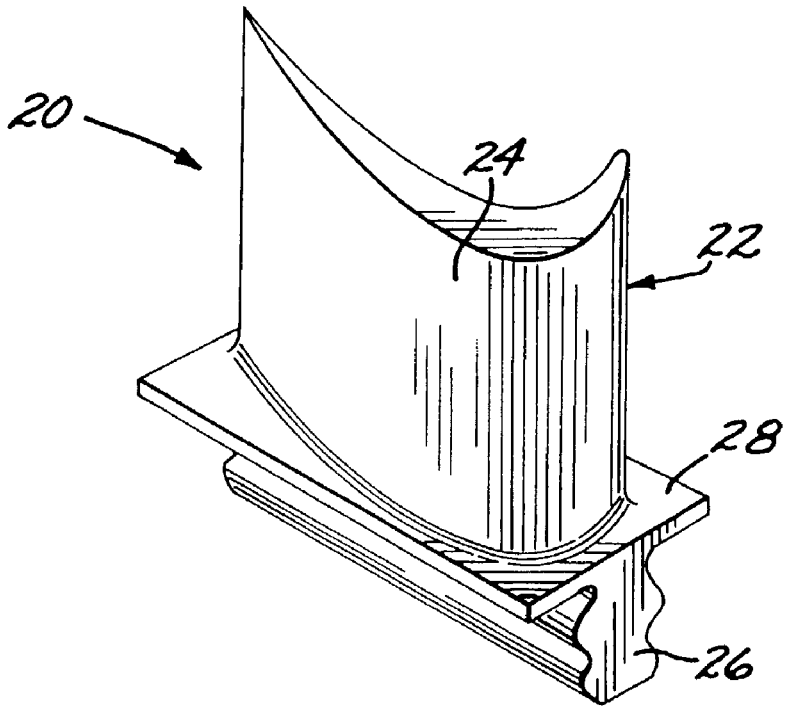
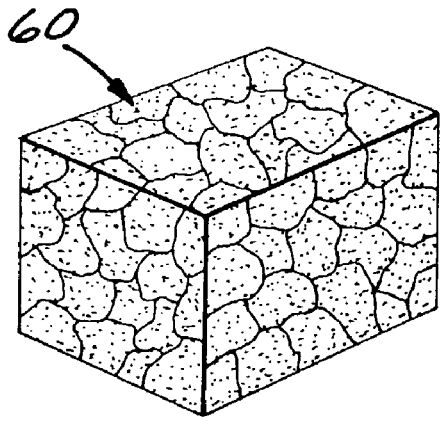
FIG. 3

METHOD FOR FABRICATING A SUPERALLOY ARTICLE WITHOUT ANY MELTING

This invention relates to the fabrication of a metallic superalloy material and article using a procedure in which the metallic superalloy is never melted.

BACKGROUND OF THE INVENTION

Superalloys are high-temperature, oxidation-resistant alloys with high strength levels. These superalloys have wide application in the aircraft propulsion industry and are also used in other industries such as automotive and chemical processing. Superalloy metallic articles are fabricated by any of a number of techniques, as may be appropriate for the nature of the metal and the article. In one common approach, metal-containing ores are refined to produce molten metal, which is thereafter cast. Ore refinement may take place separately for each of the major alloying elements, or in combination for more than one element. Elements and combinations of elements may take many intermediate forms before being melted to form the final alloy. The metal is refined as necessary to remove or reduce the amounts of undesirable minor elements. The composition of the refined metal may also be modified by the addition of desirable alloying elements. These refining and alloying steps may be performed during the initial melting process or during remelting. After a superalloy of the desired composition is produced, it may be used in the as-cast form for some superalloy compositions (i.e. cast superalloys), or it may be cast and further worked to form the metal to the desired shape for other superalloy compositions (i.e. wrought superalloys). It may instead be atomized to form fine powder and subsequently consolidated and, in some cases, further worked (i.e. powder metallurgy superalloys). In any case, further processing such as heat treating, machining, surface coating, and the like may be employed.

Regardless of processing route, all of these forms involve melt processing and are, as a result, subject to restrictions imposed by such processes. Melting of superalloy materials is typically accomplished using multiple melt processes in order to refine undesirable residual element content, to homogenize the overall composition, adjust the alloy content, and cast the final ingot or article. In multiple melt processes, intermediate cast electrodes are produced which serve as the input stock to the subsequent melting step. Melting processes include those which are not performed under vacuum such as electroslag remelting and electric arc furnace melting followed by argon-oxygen decarburization, and those which are performed under vacuum such as vacuum induction melting and vacuum arc remelting. Non-vacuum processes require the use of refining and protecting slags during the melting process. Additional limitations are also imposed as a result of the melting process for superalloys because of their composition. Alloy composition and resulting segregation issues during solidification impose practical limits on the melting rate and the maximum electrode or ingot diameters which can be produced without gross defects. In order to reduce the incidence of melt-related defects, strict melt controls are imposed so as to monitor and control melt rate, heat input, melt temperature, electrode-to-crucible clearance, and other critical parameters. Inadequate control of these parameters can result in material with significant solidification-related defects which, in turn, can reduce yield and increase production costs. In cases, such as in vacuum induction melting, where one alloy is melted in the ceramic melt crucible, and then a second alloy of a different alloy is to be subsequently melted in the same vessel, an intermediate "wash heat" is required in order to minimize alloying element contamination from one alloy to the next which may result from residual alloy material remaining on the crucible wall. This requirement adds to the overall cost of producing high-quality superalloy material.

Defects may result from melting processes or as a result of subsequent forming operations. Melt-related defects include those related to segregation as well as those resulting from extrinsic contaminants such as air and crucible ceramics. Melting of superalloys is subject to significant solidification segregation that can result in the formation of defects such as freckles, eutectic nodules, and white spots. Freckles are the result of alloying element partitioning during solidification, and are most prevalent in those materials that are highly alloyed to achieve improved properties. White spots, likewise, are a result of alloying element segregation, but can also be associated with extrinsic contamination from crucible ceramics or remnant slag inclusions (dirty white spots). These melt-related defects can significantly degrade the fatigue resistance of the superalloy material. Melt-related defects can also contribute to forging-related defects such as cracking. Some highly alloyed materials are also more difficult to form as a result of inheriting the coarse cast structure which can lead to additional forging-related defects.

Some superalloys are also produced using powder metallurgy processes to circumvent these segregation defect issues, particularly for large-diameter ingots, and to reduce the size of extrinsic contaminants resulting from the multiple melt process. The current powder metallurgy processes, however, require superalloy material to first be melted to produce alloy ingot, and then remelted and atomized to produce powder. These powder metallurgy processes add great expense and can still result in extrinsic contamination from crucible ceramics and slag. In addition, powder metallurgy processes are also subject to concerns related to inert gas entrapment in powder particles during the atomization process, which can lead to residual porosity in the resulting billet or component. These defects can degrade the fatigue properties of articles produced by the current powder metallurgy process.

As a result, melting processes impose significant limitations on the resulting article. Incremental performance improvements resulting from processing modifications and incremental improvements in production cost reduction are still possible in a number of areas. However, the present inventors have recognized in the work leading to the present invention that in other instances the fabrication approach involving multiple melt steps imposes fundamental performance limitations that cannot be overcome at any reasonable cost. They have recognized a need for a departure from the conventional thinking in fabrication technology which will overcome many of these fundamental limitations. The present invention fulfils this need, and further provides related advantages.

BRIEF SUMMARY OF THE INVENTION

The present invention provides a fabrication approach for metallic superalloy articles in which the metal is never melted. Prior fabrication techniques require melting the metal at some point in the processing. The melting operation, which often involves multiple melting and solidification steps, is costly and imposes some fundamental limitations on the properties of the final superalloy articles. In some cases, these fundamental limitations cannot be overcome, and in other cases they may be overcome only at great expense. The origin of many of these limitations may be traced directly to the fact of melting the superalloy at some point in the fabrication processing and the associated solidification from that melting. The present approach avoids these limitations entirely by not melting the superalloy metal at any point in the processing between a nonmetallic precursor form and the final metallic superalloy article.

A method for fabricating a metallic superalloy article made of metallic constituent elements comprises the steps of furnishing a mixture of nonmetallic precursor compounds of the metallic constituent elements, chemically reducing the mixture of nonmetallic precursor compounds to produce a metallic superalloy material, without melting the metallic superalloy material, and consolidating the metallic superalloy material to produce a consolidated metallic superalloy article, without melting the metallic superalloy material and without melting the consolidated metallic article. That is, the superalloy metal is never melted. The mixture of nonmetallic precursor compounds contains more of a base-metal element, selected from group consisting of nickel, cobalt, iron, iron-nickel, and iron-nickel-cobalt than any other metallic element.

As used herein, a "superalloy" is a nickel-base, cobalt-base, iron-base, iron-nickel-base, or iron-nickel-cobalt-base alloy having at least two phases, including a continuous precursor compound phase with a face-centered-cubic crystal structure that is strengthened by both solid solution strengthening and the presence of one or more additional discrete phases that are distributed throughout the precursor compound, where the discrete phases have a different composition than the precursor compound. The strengthening discrete phase or phases present in the superalloy in its fully heat treated, service condition-form, is at least about 5 percent by volume in the case of iron-base alloys, at least about 10 percent by volume in the case of nickel-base, iron-nickel-base, and iron-nickel-cobalt-base alloys, and at least about 1 percent by volume in the case of cobalt-base alloys.

An "X-base" alloy is defined as having more of metallic element(s) X than any other single element, and in many cases has more than 50 percent by weight of element(s) "X". That is, a nickel-base alloy has more nickel than any other element; a cobalt-base alloy has more cobalt than any other element; an iron-base alloy has more iron than any other element; an iron-nickel-base alloy has more of the sum of (iron plus nickel) than any other element; and an iron-nickel-cobalt-base alloy has more of the sum of (iron plus nickel plus cobalt) than any other element.

The nonmetallic precursor compounds may be solid, liquid, or gaseous. In one embodiment, the nonmetallic precursor compounds are preferably solid metallic-oxide precursor compounds. They may instead be vapor-phase reducible nonmetallic compounds of the metallic constituent elements.

The mixture of the nonmetallic precursor compounds may be provided in any operable form. For example, the mixture may be furnished as a compressed mass of particles, powders, or pieces of the nonmetallic precursor compounds, which typically has larger external dimensions than a desired final metallic article. The compressed mass may be formed by pressing and sintering. In another example, the mixture of the nonmetallic precursor compounds may be finely divided particulate or powder, and not compressed to a specific shape. In another example, the mixture may be a mixture of vapors of the precursor compounds.

The step of chemically reducing may produce a sponge of the metallic superalloy material. It may instead produce finely divided particles of the metallic superalloy material. The preferred chemical reduction approach utilizes fused salt electrolysis or vapor phase reduction.

Optionally, prior to the step of consolidating, a mixture of the metallic material and an "other additive constituent" may be produced to make the superalloy composition.

The step of consolidating may be performed by any operable technique. Preferred techniques are hot isostatic pressing, forging, pressing and sintering, or containerized extrusion of the metallic superalloy material.

The consolidated metallic article may be used in the as-consolidated form. In appropriate circumstances, it may be formed to other shapes using known forming techniques such as rolling, forging, extrusion, and the like. It may also be post-processed by known techniques such as machining, surface coating, heat treating, and the like.

Several types of solid-state consolidation are practiced in the art. Examples include hot isostatic pressing, pressing plus sintering, canning and extrusion, and forging. However, in all known prior uses of these solid-state consolidation techniques start with metallic material which has been previously melted. The present approach starts with nonmetallic precursor compounds, reduces these precursor compounds to the metallic superalloy material, and consolidates the metallic superalloy material. There is no melting of the metallic form.

The present approach differs from prior approaches in that the metal is not melted on a gross scale. Melting and its associated processing such as casting are expensive and also produce large-cast-grain-size microstructures and occasionally microstructures with local/long-range segregation such as eutectic nodules, white spots, and freckles that either are unavoidable or can be altered only with additional expensive processing modifications. Undesirable second phases which precipitate in the melt or during solidification of liquid, which are stable and cannot be dissolved in subsequent solid state processing, are avoided. These second phases are a detriment to fatigue strength, and cannot be modified by subsequent processing. However, second phases may be introduced in a more-desirable dispersed form by the present meltless approach. The present approach reduces cost and avoids large grain sizes, detrimental coarse second phases, and defects associated with melting and casting, to improve the mechanical properties of the final metallic article. It also results in some cases in an improved ability to fabricate specialized shapes and forms more readily, and to inspect those articles more readily.

The preferred form of the present approach also has the advantage of being based in a powder-like precursor. Producing a metallic powder or powder-based material such as a sponge without melting avoids a cast structure with its associated defects. Those cast-structure defects can include elemental segregation (e.g., freckles, white spots, and eutectic nodules) on a nonequilibrium microscopic and macroscopic level, a cast microstructure with a range of grain sizes and morphologies that must be homogenized in some manner for many applications, gas entrapment, and contamination. The powder-based approach herein presented produces a uniform, fine-grained, homogeneous, pore-free, gas-pore-free, and low-contamination final product.

The fine-grain structure of the sponge or powder superalloy material provides an excellent starting point for subsequent consolidation and metalworking procedures such as forging, hot isostatic pressing, rolling, and extrusion. The finer grain size aids workability because the material moves into a superplastic working range. Conventional cast starting material must be extensively worked to modify and reduce the cast structure, and such extensive working is not necessary with the present approach.

Another important benefit of the present approach is improved inspectability as compared with cast-and-wrought product. Large metallic articles used in fracture-critical applications are inspected multiple times during and at the conclusion of the fabrication processing. Cast-and-wrought product made of metals and used in critical applications such as gas turbine disks exhibits a high noise level in ultrasonic inspection due to the microstructure produced during melting, casting, and processing. The presence of this microstructure limits the ability to inspect for small defects.

The superalloy articles produced by the present approach are of a fine grain size and are free of microstructures discussed previously that inhibit inspectability. As a result, they exhibit a significantly reduced noise level during ultrasonic inspection, and permit inspection for smaller defects. The reduction in size of defects that may be detected allows larger articles to be fabricated and inspected, thus permitting more economical fabrication procedures to be adopted, and/or the detection of smaller defects. By reducing the noise associated with the inspection procedure, larger diameter intermediate-stage articles may be processed and inspected. Processing steps and costs are reduced, and there is greater confidence in the inspected quality of the final product. The resultant article that contains fewer and smaller defects also results in improved mechanical properties.

The present approach is advantageously applied to make superalloy articles (nickel-base articles, cobalt-base articles, iron-base articles, iron-nickel-base articles, and iron-nickel-cobalt-base articles). Contamination and other impurity elements that are almost unavoidable in conventional casting practice, and which may have major adverse effects on the properties of the material, may be eliminated with the present approach. The structure is more uniform and homogeneous than may be produced by conventional casting and working techniques. For the material produced by the present approach that replaces conventionally cast material, there is a reduced incidence of defects such as those produced by segregation and inclusions (e.g., white spots, freckles, eutectic nodules, and banding) during conventional casting operations, and those associated with remelted/recycled material. The cost is also reduced due to the elimination of processing steps associated with casting. The reduction in the cost of the final product achieved by the present approach also makes the superalloys more economically competitive with otherwise much less-expensive materials such as low-cost ferritic and martensitic steels in cost-driven applications. Properties are also improved. Material made by the present approach that is a replacement for conventional wrought articles realizes these same benefits. Additionally, large-sized specialty articles, whose size is limited only by compaction capability, may be made while avoiding microsegregation and macrosegregation. Reduced thermomechanical work is required to produce fine microstructures, and there is reduced loading on the mechanical working equipment. More complex processing may be used, because of the initially fine microstructure.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a perspective view of a metallic article prepared according to the present approach;

FIG. 3 is a perspective view of a spongy mass of the metallic superalloy material.

DETAILED DESCRIPTION OF THE INVENTION

Figure 2:
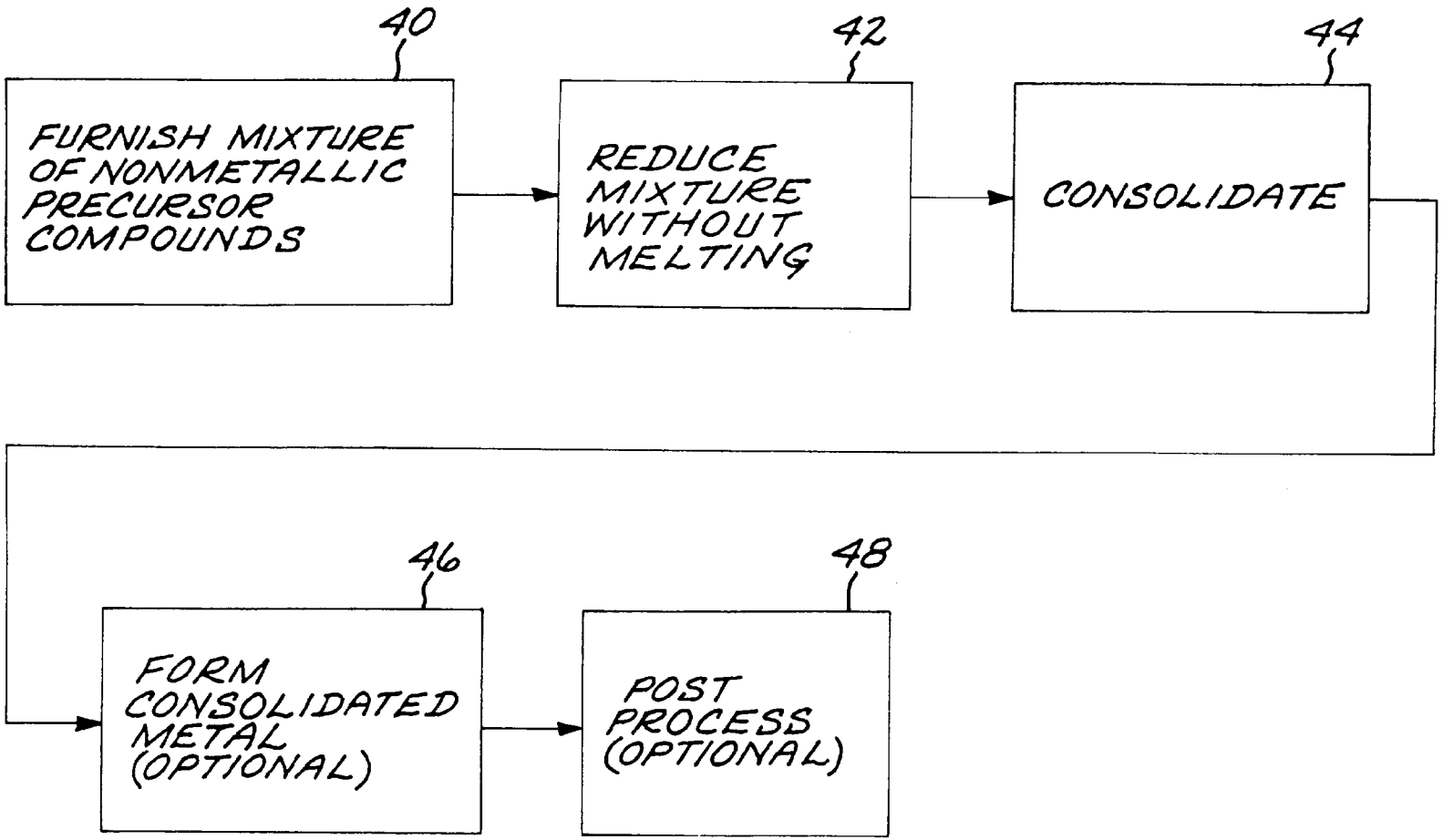
FIG. 2 is a block flow diagram of an approach for practicing the invention.

The present approach may be used to make a wide variety of metallic superalloy articles 20. An example of interest is a gas turbine blade 22 illustrated in FIG. 1. The turbine blade 22 includes an airfoil 24, an attachment 26 that is used to attach the structure to a turbine disk (not shown), and a platform 28 between the airfoil 24 and the attachment 26. The turbine blade 22 is only one example of the types of articles 20 that may be fabricated by the present approach. Some other examples include other gas turbine components such as fan blades, fan disks, compressor disks, compressor blades and vanes, turbine vanes and disks, bearings, blisks, cases, shafts, automobile parts, biomedical articles, structural members such as airframe parts, and rocket engine and other propulsion systems components. There is no known limitation on the types of articles that may be made by this approach.

FIG. 2 illustrates a preferred approach for practicing the invention. The metallic article 20 is fabricated by first furnishing a mixture of nonmetallic precursor compounds of the metallic constituent elements, step 40. "Nonmetallic precursor compounds" are nonmetallic compounds of the metals that eventually constitute the metallic article 20. Any operable nonmetallic precursor compounds may be used. The precursor compounds are nonmetallic and are selected to be operable in the reduction process in which they are reduced to metallic form. In one reduction process of interest, solid-phase reduction, the precursor compounds are preferably metal oxides. In another reduction process of interest, vapor-phase reduction, the precursor compounds are preferably metal halides. Mixtures of different types of precursor compounds may be used, as long as they are operable in the subsequent chemical reduction.

The superalloy produced by the present approach is nickel-base, cobalt-base, iron-base, iron-nickel-base, or iron-nickel-cobalt-base. An "X-base" alloy is defined as having more of metallic element(s) X than any other single element, and in many cases has more than 50 percent by weight of element(s) "X". The nonmetallic precursor compounds are selected to provide the necessary metals in the final metallic article, and are mixed together in the proper proportions to yield the necessary proportions of these metals in the final metallic article. For example, if the final article were to have a composition comparable to Alloy 718 and have particular proportions of iron, chromium, niobium plus tantalum, molybdenum, titanium, aluminum, and nickel in the ratio of 18.8 to 19 to 5.1 to 3 to 1 to 0.5 to 52.5 by weight, the nonmetallic precursor compounds in amounts to provide these proportions of the metallic elements are provided. (Minor alloying elements may also be provided in the precursor compounds.) The precursor compounds are furnished and mixed together in the correct proportions such that the ratio of the desired elements in the mixture of precursor compounds is that required to form the metallic superalloy in the final article. Nonmetallic precursor compounds that serve as a source of more than one of the metals in the final metallic article may also be used. Similar principles apply for other superalloys. Some examples of other superalloys producible by the present approach include the nickel-base superalloys Alloy 706, Alloy 720, Waspalloy, GTD222, Rene™ 220, Rene™ 88, and MERL 76; the cobalt-base superalloys HS188 and L605; and the iron-base superalloys A286 and Alloy 909. These superalloys are all known compositions that are produced by casting and/or casting and working, but may be produced in an improved manner by the present approach.

The nonmetallic precursor compounds are furnished in any operable physical form. The nonmetallic precursor compounds used in solid-phase reduction are preferably initially in a finely divided form to ensure that they are chemically reacted in the subsequent step. Such finely divided forms include, for example, powder, granules, flakes, or pellets that are readily produced and are commercially available. The nonmetallic precursor compounds in this finely divided form may be processed through the remainder of the procedure described below. In a variation of this approach, the finely divided form of the nonmetallic precursor compounds may be compressed together, as for example by pressing and sintering, to produce a preform that is processed through the remainder of the procedure. In the latter case, the compressed mass of nonmetallic precursor compounds is larger in external dimensions than a desired final metallic article, as the external dimensions are reduced during the subsequent processing.

The mixture of nonmetallic precursor compounds is thereafter chemically reduced by any operable technique to produce a metallic superalloy material, without melting the metallic superalloy material, step 42. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperature of the superalloy that forms from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred as the molten salt. The chemical reduction may be carried to completion, so that the nonmetallic precursor compounds are completely reduced. Not carrying the process to completion is a method to control the oxygen content of the metal produced.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. In one embodiment, a mixture of appropriate gases in the appropriate amounts is contacted to molten sodium, so that the metallic halides are reduced to the metallic form. The metallic superalloy is separated from the sodium. This reduction is performed at temperatures below the melting point of the metallic superalloy, so that the superalloy is not melted. The approach is described more fully in U.S. Pat. Nos. 5,779,761 and 5,958,106, whose disclosures are incorporated by reference in their entireties.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, a carbon-containing gas may be mixed with the gaseous nonmetallic precursor compound(s) to increase the level of carbon in the superalloy material. Similarly, elements such as sulfur, nitrogen, and boron may be added using appropriate gaseous compounds of these elements. Complex combinations of such gaseous elements may be provided and mixed together, such as gaseous compounds of nitrogen, sulfur, carbon, and/or boron, leading to precursor compound phase dissolution of such additive elements or to the formation of chemically more-complex second phases.

The physical form of the metallic superalloy material at the completion of step 42 depends upon the physical form of the mixture of nonmetallic precursor compounds at the beginning of step 42. If the mixture of nonmetallic precursor compounds is free-flowing, finely divided solid particles, powders, granules, pieces, or the like, the metallic superalloy material is also in the same form, except that it is smaller in size and typically somewhat porous. If the mixture of nonmetallic precursor compounds is a compressed mass of the finely divided solid particles, powders, granules, pieces, or the like, then the final physical form of the metallic superalloy material is typically in the form of a somewhat porous metallic sponge 60, as shown in FIG. 3. The external dimensions of the metallic sponge article are smaller than those of the compressed mass of the nonmetallic precursor compound due to the removal of the oxygen and/or other combined elements in the reduction step 42. If the mixture of nonmetallic precursor compounds is a vapor, then the final physical form of the metallic superalloy is typically fine or sponge-like powder that may be further processed.

Some constituents, termed "other additive constituents", may be difficult to introduce into the superalloy material. For example, suitable nonmetallic precursor compounds of the constituents may not be available, or the available nonmetallic precursor compounds of the other additive constituents may not be readily chemically reducible in a manner or at a temperature consistent with the chemical reduction of the other nonmetallic precursor compounds. It may be necessary that such other additive constituents ultimately be present as elements in solid solution in the superalloy material, as compounds formed by reaction with other constituents of the superalloy material, or as already-reacted, substantially inert compounds dispersed through the superalloy material. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 42, but only the precursor compounds are actually reduced and the other additive constituents are not reduced.

In a second approach, the other additive constituents in the form of solid particles are furnished but are not subjected to the chemical reduction treatment. Instead, they are mixed with the initial metallic material that results from the chemical reduction step, but after the step of chemically reducing 42 is complete. This approach is particularly effective when the step of chemically reducing is performed on a flowing powder of the precursor compounds, but it also may be performed on a pre-compacted mass of the precursor compounds, resulting in a spongy mass of the initial metallic material. The other additive constituents are adhered to the surface of the powder or to the surface of, and into the porosity of, the spongy mass.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor or elemental form (e.g., methane or nitrogen gas) is flowed over surface of particle or sponge to deposit the element onto the surface from the gas.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into the superalloy material by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge.

Whatever the reduction technique used in step 42 and however the other additive constituent is introduced, the result is a mixture that comprises the superalloy composition. The metallic superalloy material may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The chemical composition of the metallic superalloy material is determined by the types and cumulative amounts of the metals in the mixture of nonmetallic precursor compounds furnished in step 40 or added during processing.

The metallic superalloy material is in a form that is not structurally useful for most applications. Accordingly, the metallic superalloy material is thereafter consolidated to produce a consolidated metallic article, without melting the metallic superalloy material and without melting the consolidated metallic article, step 44. The consolidation removes porosity from the metallic superalloy material, desirably increasing its relative density to or near 100 percent. Any operable type of consolidation may be used. Preferably, the consolidation 44 is performed by hot isostatic pressing the metallic superalloy material under appropriate conditions of temperature and pressure, but at a temperature less than the melting points of the metallic superalloy material and the consolidated metallic article (which melting points are typically the same or very close together). Pressing and solid-state sintering or extrusion of a canned material may also be used, particularly where the metallic superalloy material is in the form of a powder. The consolidation reduces the external dimensions of the mass of metallic superalloy material, but such reduction in dimensions is predictable with experience for particular compositions. The consolidation processing 44 may also be used to achieve further alloying of the metallic article with alloying elements such as nitrogen.

The consolidated metallic article, such as that shown in FIG. 1, may be used in its as-consolidated form. Instead, in appropriate cases the consolidated metallic article may optionally be formed, step 46, by any operable metallic forming process, as by forging, extrusion, rolling, and the like. Some metallic compositions are amenable to such forming operations, and others are not. However, the superalloy article consolidated by the present approach will be much more amenable to forming operations than its equivalent cast-and-wrought composition due to its finer grain size and potential for superplastic forming.

The consolidated metallic article may also be optionally post-processed by any operable approach, step 48. Such post-processing steps may include, for example, heat treating, surface coating, machining, and the like. The steps 46 and 48 may be performed in the indicated order, or step 48 may be performed prior to step 46.

The metallic superalloy material is never heated above its melting point. Additionally, it may be maintained below specific temperatures that are themselves below the melting point, such as various precipitate (e.g., gamma prime, gamma-double-prime, or carbide) solvus temperatures.

In other cases, it is desirable to heat the superalloy above a particular solvus temperature in order to achieve a specific type of microstructure.

The present approach processes the mixture of nonmetallic precursor compounds to a finished metallic form without the metal of the finished metallic form ever being heated above its melting point. Consequently, the process avoids the costs associated with melting operations, such as controlled-atmosphere or vacuum furnace costs. The microstructures associated with melting, typically large-grained structures, casting defects, and segregation-related defects (e.g., freckles, white spots, and eutectic nodules), are not found. Without such defects, the reliability or the articles is improved. The greater confidence in the defect-free state of the article, achieved with the better inspectability discussed above, also leads to a reduction in the extra material that must otherwise be present. Mechanical properties such as static strength and fatigue strength are improved, potentially allowing the articles to be lighter in weight. Inspectability is improved, and the product has reduced cost, defects, and porosity, as compared with the product of other powder metallurgy processing.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating a metallic article made of metallic constituent elements, comprising the steps of furnishing a mixture of nonmetallic precursor compounds of the metallic constituent elements;

chemically reducing the mixture of nonmetallic precursor compounds to produce a metallic superalloy material, without melting the metallic superalloy material, wherein the metallic superalloy material is a nickel-base superalloy having at least about 10 percent by volume of one or more strengthening discrete phases, or a cobalt-base superalloy having at least about 1 percent by volume of one or more strengthening discrete phases, or an iron-base alloy having at least about 5 percent by volume of one or more strengthening phases, or an iron-nickel-base superalloy having at least about 10 percent by volume of one or more strengthening phases, or an iron-nickel-cobalt-base superalloy having at least about 10 percent by volume of one or more strengthening phases; and consolidating the metallic superalloy material to produce a consolidated metallic article, without melting the metallic superalloy material and without melting the consolidated metallic article.

2. The method of claim 1, wherein the step of furnishing the mixture includes the step of furnishing the metallic precursor compounds in finely divided particulate form.

3. The method of claim 1, wherein the step of furnishing the mixture includes the step of furnishing a compressed mass of the nonmetallic precursor compounds.

4. The method of claim 1, wherein the step of furnishing the mixture includes the step of furnishing a compressed mass of the nonmetallic precursor compounds larger in dimensions than the consolidated metallic article.

5. The method of claim 1, wherein the step of furnishing the mixture includes the step of furnishing the mixture comprising metallic-oxide precursor compounds.

6. The method of claim 1, wherein the step of furnishing the mixture includes the step of furnishing the mixture comprising metal halide precursor compounds.

7. The method of claim 1, wherein the step of furnishing the mixture includes the step of furnishing the mixture comprising more nickel than any other metallic element.

8. The method of claim 1, wherein the step of furnishing the mixture includes the step of furnishing the mixture comprising more cobalt than any other metallic element.

9. The method of claim 1, wherein the step of furnishing the mixture includes the step of furnishing the mixture comprising more iron than any other metallic element.

10. The method of claim 1, wherein the step of furnishing the mixture includes the step of furnishing the mixture comprising more (iron plus nickel) than any other metallic element.

11. The method of claim 1, wherein the step of furnishing the mixture includes the step of furnishing the mixture comprising more (iron plus nickel plus cobalt) than any other metallic element.

12. The method of claim 1, wherein the step of chemically reducing includes the step of producing a sponge of the metallic superalloy material.

13. The method of claim 1, wherein the step of chemically reducing includes the step of producing a powder of the metallic superalloy material.

14. The method of claim 1, wherein the step of chemically reducing includes the step of chemically reducing the mixture of nonmetallic precursor compounds by solid-phase reduction.

15. The method of claim 1, wherein the step of chemically reducing includes the step of chemically reducing the mixture of nonmetallic precursor compounds by vapor-phase reduction.

16. The method of claim 15, including an additional step, performed prior to the step of chemically reducing, of mixing a gaseous modifier comprising a modifying element into the mixture of nonmetallic precursor compounds.

17. The method of claim 1, including an additional step, prior to the step of consolidating, of producing a mixture of a metallic material and an other additive constituent that together have the superalloy composition.

18. The method of claim 1, wherein the step of consolidating includes the step of consolidating the metallic superalloy material using a technique selected from the group consisting of hot isostatic pressing, forging, pressing and sintering, and contained extrusion.

19. The method of claim 1, including an additional step, after the step of consolidating, of forming the consolidated metallic article.

20. The method of claim 1, wherein the step of consolidating includes the step of consolidating the metallic superalloy material to produce a gas turbine component.

21. A method for fabricating a metallic article made of metallic constituent elements, comprising the steps of furnishing a mixture of nonmetallic precursor compounds of the metallic constituent elements;

chemically reducing the mixture of nonmetallic precursor compounds to produce a metallic material, without melting the metallic material, wherein the metallic material is a nickel-base superalloy having at least about 10 percent by volume of one or more strengthening discrete phases or a cobalt-base superalloy having at least about 1 percent by volume of one or more strengthening discrete phases; and consolidating the metallic material to produce a consolidated metallic article, without melting the metallic material and without melting the consolidated metallic article.

22. The method of claim 21, wherein the step of furnishing the mixture includes the step of furnishing a compressed mass of the nonmetallic precursor compounds.

23. The method of claim 21, wherein the step of furnishing the mixture includes the step of furnishing the mixture comprising metallic-oxide precursor compounds.

24. The method of claim 21, wherein the step of furnishing the mixture includes the step of furnishing the mixture comprising metal halide precursor compounds.

25. The method of claim 21, wherein the step of chemically reducing includes the step of producing a sponge of the metallic superalloy material.

26. The method of claim 21, wherein the step of chemically reducing includes the step of chemically reducing the mixture of nonmetallic precursor compounds by vapor-phase reduction.

27. The method of claim 21, including an additional step, prior to the step of consolidating, of producing a mixture of a metallic material and an other additive constituent that together have the superalloy composition.

28. The method of claim 21, wherein the step of consolidating includes the step of consolidating the metallic superalloy material using a technique selected from the group consisting of hot isostatic pressing, forging, pressing and sintering, and containered extrusion.

29. The method of claim 21, including an additional step, after the step of consolidating, of forming the consolidated metallic article.

30. The method of claim 21, wherein the metallic superalloy material is the nickel-base superalloy having at least about 10 percent by volume of one or more strengthening discrete phases.

31. The method of claim 21, wherein the metallic superalloy material is the cobalt-base superalloy having at least about 1 percent by volume of one or more strengthening discrete phases.

32. The method of claim 1, wherein the metallic superalloy material is the iron-base alloy having at least about 5 percent by volume of one or more strengthening phases.

33. The method of claim 1, wherein the metallic superalloy material is the iron-nickel-base superalloy having at least about 10 percent by volume of one or more strengthening phases.

34. The method of claim 1, wherein the metallic superalloy material is the iron-nickel-cobalt-base superalloy having at least about 10 percent by volume of one or more strengthening phases.

35. A method for fabricating a metallic article made of metallic constituent elements, comprising the steps of furnishing a mixture of nonmetallic metal halide precursor compounds of the metallic constituent elements;

chemically reducing the mixture of nonmetallic precursor compounds to produce a metallic superalloy material, without melting the metallic superalloy material; and consolidating the metallic superalloy material to produce a consolidated metallic article, without melting the metallic superalloy material and without melting the consolidated metallic article.

36. A method for fabricating a metallic article made of metallic constituent elements, comprising the steps of furnishing a mixture of nonmetallic precursor compounds of the metallic constituent elements;

chemically reducing the mixture of nonmetallic precursor compounds to by vapor-phase reduction produce a metallic superalloy material, without melting the metallic superalloy material; and consolidating the metallic superalloy material to produce a consolidated metallic article, without melting the metallic superalloy material and without melting the consolidated metallic article.

37. A method for fabricating a metallic article made of metallic constituent elements, comprising the steps of furnishing a mixture of nonmetallic precursor compounds of the metallic constituent elements;

mixing a gaseous modifier comprising a modifying element into the mixture of nonmetallic precursor compounds; thereafter chemically reducing the mixture of nonmetallic precursor compounds to produce a metallic superalloy material, without melting the metallic superalloy material; and consolidating the metallic superalloy material to produce a consolidated metallic article, without melting the metallic superalloy material and without melting the consolidated metallic article.

38. A method for fabricating a metallic article made of metallic constituent elements, comprising the steps of furnishing a mixture of nonmetallic metal halide precursor compounds of the metallic constituent elements;

chemically reducing the mixture of nonmetallic precursor compounds to produce a metallic material, without melting the metallic material, wherein the metallic material is a nickel-base superalloy or a cobalt-base superalloy; and consolidating the metallic material to produce a consolidated metallic article, without melting the metallic material and without melting the consolidated metallic article.

39. A method for fabricating a metallic article made of metallic constituent elements, comprising the steps of furnishing a mixture of nonmetallic precursor compounds of the metallic constituent elements;

chemically reducing the mixture of nonmetallic precursor compounds by vapor-phase reduction to produce a metallic material, without melting the metallic material, wherein the metallic material is a nickel-base superalloy or a cobalt-base superalloy; and consolidating the metallic material to produce a consolidated metallic article, without melting the metallic material and without melting the consolidated metallic article.

* * * * *